US006330781B1

(12) United States Patent
Meroth

(10) Patent No.: US 6,330,781 B1
(45) Date of Patent: Dec. 18, 2001

(54) SAFETY SUPPORT

(76) Inventor: Erwin Meroth, Maternusstrasse 3, D-50996 Köln (DE)

( * ) Notice: Subject to any disclaimer, the term of this patent is extended or adjusted under 35 U.S.C. 154(b) by 0 days.

(21) Appl. No.: 09/485,644

(22) PCT Filed: Apr. 29, 1998

(86) PCT No.: PCT/DE98/01192

§ 371 Date: Feb. 11, 2000

§ 102(e) Date: Feb. 11, 2000

(87) PCT Pub. No.: WO99/08957

PCT Pub. Date: Feb. 25, 1999

(30) Foreign Application Priority Data

Aug. 14, 1997 (DE) ..... 197 35 211

(51) Int. Cl.[7] ..... B68C 3/02
(52) U.S. Cl. ..... 54/49
(58) Field of Search ..... 54/47, 49

(56) References Cited

U.S. PATENT DOCUMENTS 143,732 * 10/1873 Thompson ..... 54/49
842,702 * 1/1907 Reim ..... 54/49
3,276,185 * 10/1966 Jahn ..... 54/49

FOREIGN PATENT DOCUMENTS 25 481 7/1883 (DE) .

* cited by examiner

*Primary Examiner*—Robert P. Swiatek
(74) *Attorney, Agent, or Firm*—Akerman Senterfitt

(57) ABSTRACT

A safety support comprising a plate with ribs and a U-shaped upper part with two lateral branches and an upper base zone. The two lateral branches each comprise an articulation zone including pivoting axles extending parallel to the plane defined by the upper part and two superposed connecting zones, which are mutually linked by an assembly part, each having a bore for its respective pivoting axle. Moreover, each articulation zone comprises at least three pivoting axles, the connecting zones have each an arc-shaped part, defined by two flattened zones extending parallel to the plane, and the two neighbouring articulation pins are each mutually linked by two assembly parts.

12 Claims, 1 Drawing Sheet

SAFETY SUPPORT

BACKGROUND OF THE INVENTION

Figure 1:
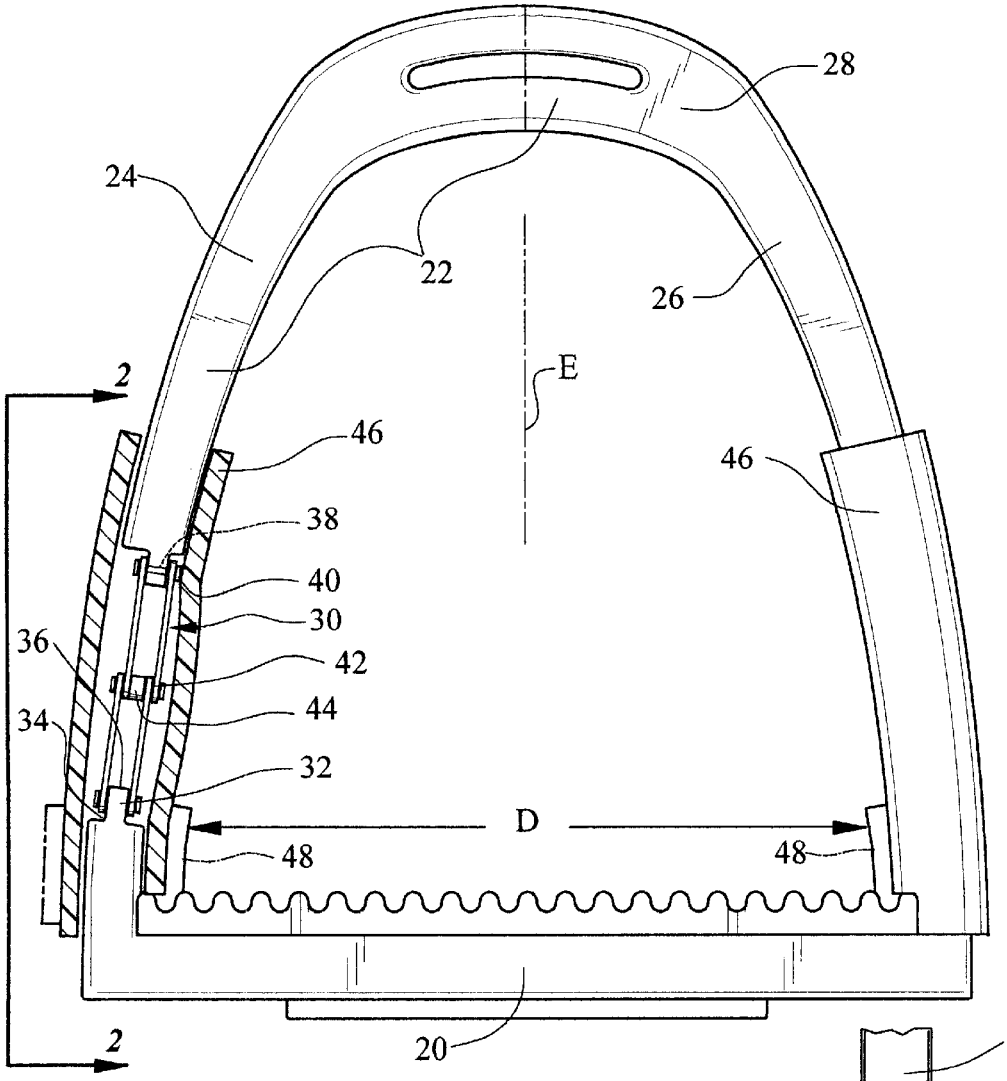

The invention relates to a safety stirrup with a web plate and with a U-shaped upper part which has two lateral legs and an upper base region, the two lateral legs being each provided with an articulated area having swivel axles running across the plane defined by the upper part and two connecting areas being each provided with a bore for a swivel axle.

This safety stirrup, which is being offered for sale, is standing the test very well. The articulated areas are provided in the lower part of the two lateral legs, which is adjacent to the web plate. They allow the web plate to swing relative to the upper base region and to the adjacent part of the lateral legs which is rigidly mounted to the upper base region above the articulated areas.

In the safety stirrup of the art, two swivel axles are provided in either articulated area. For the formation of the articulated area, an incision running parallel to the mentioned plane and receiving a connecting part is provided in either of the two associated connecting areas. The associated swivel axles are inserted in a bore provided across the mentioned plane in either connecting area.

Due to the fact that the two connecting areas of either articulated area are connected by only one connecting part, the safety stirrup of the art is mechanically weak when loaded across the plane of the plate-shaped connecting parts, that is across the mentioned plane. The construction of the articulated areas is not satisfactory either. It happens over and over again that the protecting hose sheathing each articulated area wears through. Additionally, the articulated areas are often quite sluggish.

That is where the invention comes to bear. Its object is to develop the safety stirrup of the type mentioned above in such a way that it becomes safer, better suited to the needs of a user and easy-running in the articulated areas.

Footing on the safety stirrup of the type mentioned above, the solution of this object is to provide each articulated area with at least three swivel axles, each connecting area with a semicircular part limited by two flattened areas running parallel to the mentioned plane and to connect together two adjacent hinge pins by means of two connecting parts each.

This safety stirrup has at least one more swivel axle, called in the following free swivel axle, which is located between the two swivel axles provided in either of the two opposite connecting areas of an articulated area. Preferably, two free swivel axles are provided between the swivel axles of the connecting areas so that the safety stirrup has four joints in each articulated area. Due to the number of at least three swivel axles or hinge pins for each articulated area, each articulated area is much more flexible and easy-running than the articulated area in the safety stirrup of the art. The protection hose requires therefor less solidity or rigidity, as it may be measured in Shore hardness for example. Thus, each articulated area is constructed at lower cost.

It is particularly advantageous that at least one free swivel axle is provided for each articulated area, since this ensures the adaptability of a safety stirrup constructed according to this feature. Indeed, according to the wishes of a user, the leg can be lengthened by inserting additional swivel axles. Safety stirrups may thus better adjust to the wishes of the user. It is even possible to have one of the legs constructed with more or less swivel axles than the other leg.

A particular advantage of the invention is that two adjacent swivel axles are connected together by two connecting parts arranged parallel to one another. Thus, buckling movements across the swivel axles and across the planes of the connecting parts are nearly impossible. The connecting parts are forming couples whereas the two connecting parts of either couple are arranged at the biggest possible distance from each other. This spacing should amount to at least 2, preferably at least 4 mm. The invention takes advantage of an idea used also for the chains of bicycles, motorbikes and the like. The invention preferably uses connecting parts having essentially the shape of an 8, as they are also used in such chains. The invention uses thus for the construction of the articulated areas component parts as they are known from the above-mentioned chains. Since such chains are extremely strong and articulated and since they stood the test in practical operation, their qualities have also been adopted for the safety stirrups.

In either of the free swivel axles, spacer blocks are also used to the same effect. The spacer blocks used therefor are the same as those used for bicycle chains or the like.

As opposed to the state of the art, the design of the connecting areas is completely different. They are no longer provided with an incision, but are limited by two parallel flattened areas showing outwards away from each other and extending parallel to the mentioned plane and by an arched area arranged crosswise. This arched area is preferably an arc of a circle. The bore for the swivel axle is located in its center.

Two connecting areas constructed according to this teaching as they are provided for either articulated area are linked together by piece parts of a chain of the type mentioned above. A piece of an already assembled chain may be used. In this case, the free swivel axles do not require any particular phase of operation since the free swivel axles are already there. The distance between the two flattened areas is then adapted to the clearance between two connecting parts of a commercial chain. Hinge pins as they are used in chains are also used to establish the swivelling connection in the area of the hinge pins of the connecting areas.

By using pieces of chains to construct the articulated areas, the inner casing of a sheathing hose is spared and incisions and so on as they were to be found in the safety stirrup mentioned at the beginning, are avoided. The thickness and depth of the pieces of chain inserted square with the corresponding dimensions of the adjacent areas of the legs. Thus, the pieces of chain do not protrude.

Figure 2:
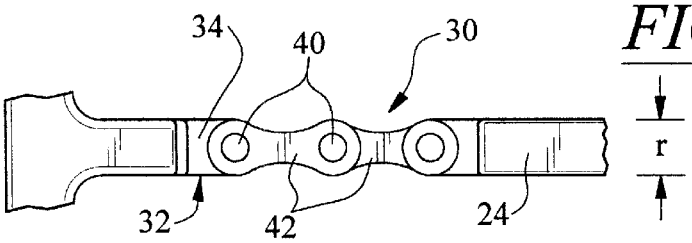
Figure 3:
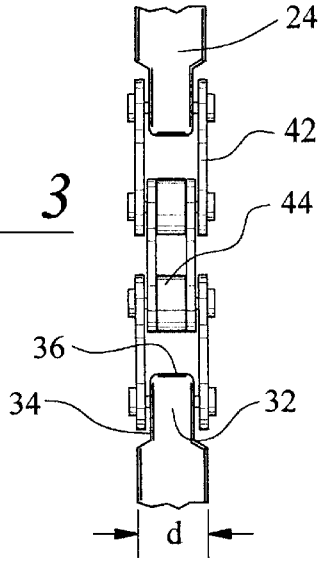

Further advantages and characteristics of the invention will become clear in the remaining subclaims and in the following description of an embodiment that is only an example and is not limiting the scope of the invention. Said embodiment is explained in more detail with the aid of the drawing. It shows:

FIG. 1: a top view of a stirrup according to the invention,

FIG. 2: a view along the line II—II in FIG. 1 but without the sectional representation of the protecting hose in FIG. 1 and FIG. 3: a view according to FIG. 2 but without protecting hose and turned by 90 degrees, and now for an articulated area with four swivel axles and not with three like in FIG. 2.

The stirrup as it is represented as a whole in FIG. 1 has a web plate 20 with a supporting area for a not represented shoe or boot and a U-shaped upper part 22. The latter is provided with two lateral legs 24,26 and with an upper base area 28 having an opening or any other manner of fastening for a stirrup leather.

In their lower part, the two legs 24, 26 are each provided with an articulated area 30.

In a preferred way of production, a commercial, integral stirrup is taken and the legs 24, 26 are cut through. Then, the joint arrangement as it will be described in the following is inserted between the edges of the cut. The cuts are made approximately 10 to 50, particularly 20 to 30 mm above the upper edge, that is above the supporting surface of the web plate 20. Thus, the sole of a shoe or a boot remains underneath the respective articulated areas 30. In the embodiment shown, the web plate 20 is provided with a rubber layer of the art.

To construct each articulated area, a piece of a commercial bicycle or motorbike chain is inserted between two connecting areas 32. For producing the safety stirrup according to the invention in the way described above out of an integral, particularly cast stirrup, the part added on to the edges of the cut after the legs 24, 26 have been cut through is designed to form a connecting area 32 by first of all constructing two parallel flattened areas 34 , which can be done by milling for example, second by constructing a bow-shaped section 36 limited by an arch, particularly by an arc of a circle, and arranged crosswise and third by providing a bore 38 for a hinge pin 40. The sequence of these steps is arbitrary. The bore 38 is located in the center of the bow-shaped section 36 which has here a circular shape. The hinge pins 40 correspond to those used in the chains mentioned.

The thus provided connecting areas 32 are linked together by a piece of chain as already explained above. This piece of chain consists of at least two couples of connecting parts 42, of at least one hinge pin 40 and of one spacer cylinder 44. The connecting areas 32 of a joint area are preferably identical.

In the embodiment according to FIG. 3, a free swivel axle is located between the two swivel axles of the two connecting areas 32. Each articulated area 30 has thus altogether three swivel axles. They run across a plane E shown by a broken line in FIG. 1 which is defined by the U-shaped upper part 22 and which is also perpendicular to the plane of the drawing according to FIG. 1. All the hinge pins 40 of the two articulated areas 30 of a safety stirrup are parallel to one another. Their spacing is the same, it amounts to e.g. 10 to 15, more particularly 12.5 mm.

The connecting parts 42 have essentially the shape of an 8. They have two bores each for two adjacent hinge pins 40. Two adjacent hinge pins 40 are connected to one another by two parallel connecting parts 42. Where two couples of connecting parts 42 share the same hinge pin 40, that is in the case of the free swivel axles, the connecting parts of one couple are offset relative to those of the other couple, e.g. offset inwards or outwards as may particularly be seen in the FIGS. 1 and 3. Thus, the couples of connecting parts 42 have the same or different clearances. The principle of construction illustrated in FIG. 1 proved effective particularly with safety stirrups with an odd number of free swivel axles. The couples of connecting parts 42 have hereby the same clearances The upper couple of the two couples in FIG. 1 is offset inwards and this corresponds to the curve of the leg in this area.

In the embodiment according to FIG. 3, another principle of construction has been materialized. Like in a real chain, the central couple of connecting parts 42 was offset inwards so that the clearance of the two connecting parts 42 is smaller than the clearance of the connecting parts 42 of the two outer couples. But it is also absolutely possible to displace one connecting part 42 of the central couple particularly the inner connecting part 42, to the outside. The articulated area of FIG. 3, which is equipped with four articulated axles, can also be built according to FIG. 1, whereas the upper couple is once more offset to the right and added on to the central couple of connecting parts 42. By inserting a desired number of connecting parts and of corresponding hinge pins, the length of the legs may be adjusted to the requirements of the user.

As may be seen in the Figures, particularly in FIG. 3, the thickness of the material d or r of the two legs 24, 26 in the vicinity of the articulated area 30 is at least so big that d is bigger than the length of a hinge pin 40 and that r is equal or slightly bigger than the corresponding width of a connecting part 42. Thus, the chosen pieces of chain fit in the legs without any protruding parts. In the main, they should not show any setoff to the back either. The preferred cross section of the legs 24, 26 is such that it fits the corresponding cross section of the chosen piece of chain.

Usually, the two articulated areas 30 of a stirrup are identical in construction. Their construction may however be different, too. One leg may be provided with an articulated area with three swivel axles, whereas the other one may have an articulated area with four swivel axles.

The articulated areas 30 are sheathed by a protecting hose 46 sitting close to the adjacent leg areas of the legs 24, 26 and protecting thus in the best possible way the articulated areas against dirt and humidity. Additionally, the protecting hose 46 may be sealed relative to the leg parts 24, 26 by appropriate measures like for example silicone or the like.

The clearance between two protecting hoses 46 is adjusted to the size of a sole of a rider's boot or shoe. Widening parts 48 may additionally be inserted, as they are for example represented in FIG. 1. They are, e.g., designed as short hose sections located outside the protecting hose 46. The clear width D is chosen so that the sole is slightly squeezed. Thus, a secure coordination of stirrup and sole is achieved.

The protecting hose is preferably made of the elastomer EPDM. It has a Shore hardness A of 50 to 80, preferably of 60 to 70, particularly of 65. The elongation at tear amounts to more than 300%, it is preferably equal to/bigger than 400%. The ultimate tensile strength is bigger than 10 $N/mm^2$.

Conditioned by manufacturing, the different articulated areas 30 may be turned slightly. Such a torsion can also be made consciously up to +/−5°, particularly up to +/−10° torsion, preferably up to +/−15° torsion around the axis of the articulated area 30. Thus, the web plate 20 is pivotable relative to the upper part 22. Such a degree of freedom is advantageous for riders having a problem with their knee (a problem with the meniscus, e.g.).

What is claimed is:

1. A safety stirrup with a web plate and with a U-shaped upper part which has two lateral legs and an upper base region, the two lateral legs being each provided with an articulated area having swivel axles running across the plane defined by the upper part and two connecting areas arranged opposite each other and connected by a connecting part, said connecting areas being each provided with a bore for the swivel axle, wherein each articulated area is provided with at least three swivel axles, each connecting area has a bow-shaped part limited by two flattened areas running parallel to the mentioned plane and two adjacent hinge pins are connected together by means of two connecting parts each.

2. Safety stirrup according to claim 1, wherein the connecting parts are essentially given the shape of an 8.

3. Safety stirrup according to claim 2, wherein the connecting parts are those of a bicycle chain.

4. Safety stirrup according to claim 1, wherein only one free swivel axle is located in either articulated area between the two swivel axles provided in the connecting areas.

5. Safety stirrup according to claim 1, wherein two free swivel axles are located in either articulated area between the two swivel axles provided in the connecting areas.

6. Safety stirrup according to claim 1, wherein the bow-shaped parts are limited at their free end by a cylinder jacket.

7. Safety stirrup according to claim 1, wherein the hinge pins have been broadened at their ends.

8. Safety stirrup according to claim 1, wherein at least one free swivel axle passes through a spacer block which is preferably designed as a cylinder.

9. Safety stirrup according to claim 1, wherein the connecting parts are offset two by two in the area of at least one free swivel axle so as to cross its line of orientation.

10. Safety stirrup according to claim 1, wherein each of the articulated areas is sheathed by a hose made of elastomer, said hose extending beyond the actual length of the articulated areas on either side of the corresponding articulated area.

11. Safety stirrup according to claim 10, wherein said hose is made of rubber.

12. Safety stirrup according to claim 1, wherein each couple of connecting parts between two swivel axles has the biggest possible spacing relative to each other.

* * * * *

UNITED STATES PATENT AND TRADEMARK OFFICE

CERTIFICATE OF CORRECTION

PATENT NO. : 6,330,781 B1
DATED : December 18, 2001
INVENTOR(S) : Erwin Meroth

It is certified that error appears in the above-identified patent and that said Letters Patent is hereby corrected as shown below:

Column 6,
Lines 4-10, Claims 10 and 11 of the issued patent should be cancelled.

Signed and Sealed this

Sixteenth Day of July, 2002

*Attest:*

*Attesting Officer*

JAMES E. ROGAN
*Director of the United States Patent and Trademark Office*